United States Patent [19]

Dvorsky et al.

[11] 4,331,441

[45] May 25, 1982

[54] METHOD OF DYEING CELLULOSE FIBERS BY ANIONIC DYES, COMPOUND FOR USE IN SUCH METHOD, AND METHOD OF MAKING THE COMPOUND

[75] Inventors: Drahomir Dvorsky; Karel Cerovský, both of Dvur Kralove n/Labem, Czechoslovakia

[73] Assignee: Vyzkumny ustav zuslechtovaci, Dvis Kralove n/Labem, Czechoslovakia

[21] Appl. No.: 182,868

[22] Filed: Jul. 28, 1980

[30] Foreign Application Priority Data

Jul. 26, 1979 [CS] Czechoslovakia ..... 5195-79

[51] Int. Cl.[3] ..... D06P 1/645; C07C 87/30

[52] U.S. Cl. ..... 8/542; 8/541; 8/529; 8/606; 564/285

[58] Field of Search ..... 8/529, 541, 542, 606

[56] References Cited

U.S. PATENT DOCUMENTS

| | | | |
|---|---|---|---|
| 3,643,270 | 2/1972 | Kirschnek et al. | 8/606 |
| 3,988,111 | 10/1976 | Balland | 8/541 |
| 4,090,845 | 5/1978 | Petzold et al. | 8/606 |

FOREIGN PATENT DOCUMENTS

| | | | |
|---|---|---|---|
| 55-45860 | 3/1980 | Japan | 8/541 |

*Primary Examiner*—Maria Parrish Tungol

[57] ABSTRACT

Compound for use in the dyeing of cellulosic fibers by anionic dyes, method of making such compound and method of dyeing involving the use of such compound. The compound has the general formula

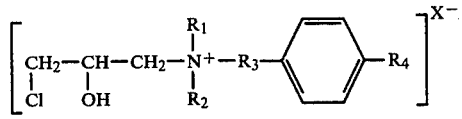

wherein $R_1$ and $R_2$ are alkyls with 1-3 carbon atoms, $R_3$ is alkylene with 1-2 carbon atoms, $R_4$ is a hydrogen atom or an alkyl with 1-2 carbon atoms, and X is an anion of a strong inorganic ore organic acid. Such compound may be produced by a method in which 70 to 80 parts by weight of 35% hydrochloric acid are gradually added to 100 parts by weight of N,N-dimethylbenzylamine whereupon the temperature of the reaction compound is adapted to the value of 40° to 80° C. and 55 to 75 parts by weight of epichlorhydrin are gradually added, wherein the temperature of the resulting compound is kept between 60° to 100° C. over the course of 60 to 120 minutes since the last addition of epichlorhydrin.

3 Claims, No Drawings

METHOD OF DYEING CELLULOSE FIBERS BY ANIONIC DYES, COMPOUND FOR USE IN SUCH METHOD, AND METHOD OF MAKING THE COMPOUND

The invention relates to a method of dyeing cellulose fibers by using anionic dyes, the method improving the utilization and fastness of such dyes. The invention also relates to a compound for use in the dyeing method, and to a method of making such compound.

To improve the fastness and utilization of some anionic dyes, and particularly those of substantive and reactive types, there have been proposed and patented a number of epoxy ammonium compounds.

Rupin has referred to N(2,3-epoxypropyl)-N,N,N-trimethylammonium choride; this compound is apt to react with hydroxyl groups of cellulose by its epoxy group upon the formation of cellulose ether. A quaternary ammonium group is capable of binding anionic dyes and thereby enhancing their fastness and utilization. The reaction of the above-mentioned compound can take place before or simultaneously with the dyeing process.

A disadvantage of such a process is that this compound liberates, especially in an alkaline medium, trimethylamine which is characterized by its bad smell. Odorization problems appear to constitute the main reason why the process has not yet been widely used.

Another compound which may improve the fastness especially of substantive dyes is N(2,3-epoxypropyl)-N-morpholinium chloride.

When compared with the afore-mentioned compound, its bad smell is negligible but its effectiveness is lower.

The problem of developing a highly effective and odorless agent for the above purpose has been solved by providing a compound type according to the invention such compound having the general formula

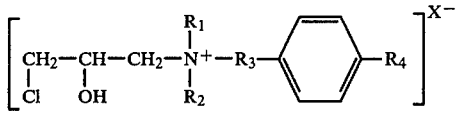

wherein $R_1$ and $R_2$ are alkyls with 1–3 carbon atoms, $R_3$ is alkylene with 1–2 carbon atoms, $R_4$ is hydrogen atom or alkyl with 1–2 carbon atoms, and X is anion of a strong inorganic or organic acid. Such compound may be produced by a method in which 70 to 80 parts by weight of 36% hydrochloric acid are gradually added to 100 parts by weight of N,N-dimetylbenzylamine whereupon the temperature of the reaction compound is adapted to the value of 40° to 80° C. and 55 to 75 parts by weight of epichlorhydrin are gradually added, wherein the temperature of the resulting compound is kept between 60° to 100° C. over the course of 60 to 120 minutes since the last addition of epichlorhydrin.

In an alkaline medium, the compound according to the invention converts into a type of epoxy ammonium compounds of the formula

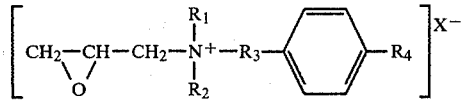

which are capable of reacting with cellulose.

The compounds according to the invention are generally produced by the method in which N,N-dialkyl-N-alkylarylamines are converted into salts by the influence of hydrohaloic acids, whereupon they quarternize under the influence of epichlorhydrin.

The compounds according to the invention are stable during a long storage life, are highly effective and odorless. They can be used for cationization of cellulose before or simultaneously with the dyeing process. Some preferred applications thereof are set forth in the following examples.

EXAMPLE 1

A pretreated cotton fabric was soaked in a padder with a liquor containing:

20 grams per liter of N(2-hydroxy-3chloropropyl)-N-benzyl-N,N-dimethylammonium chloride, 15 grams per liter of Direct Blue Color Index No. 109 and 15 grams per liter of sodium hydroxide.

The fabric was soaked at 70% extraction at 20° C.

The fabric was kept for 12 hours in batch in the above liquor at a temperature of from 20° to 25° C., after which it was washed in water at 60° C.

The result was a deep brilliant blue tone with excellent wet fastness values.

EXAMPLE 2

A pretreated fabric made of cotton/rayon blend (67/33) was soaked in a padder with a liquor containing:

25 grams liter of N(2-hydroxy-3-chloropropyl)-N-ethylene-phenyl-N,N-dimethylammonium bromide and 25 grams per liter of sodium carbonate.

The fabric was soaked in the liquor at 80 percent extraction, dried at 100° C., and fixed at 140° C. hotflue for 80 seconds.

The impregnation was followed by washing and dyeing in a jigger with Reactive Blue Color Index No. 5 to 3 percent deepness.

The dyeing process was carried out for 60 minutes at 80° C. without the usual salt and alkali additives. The process was finished by the usual washing and soaping at the boil.

The resulting color was characterized by its relatively high wet fastness values, and the dye was almost fully utilized in the dyeing process.

EXAMPLE 3

A pretreated linen yarn on cross-wound packages was treated in a dyeing machine in a one to four liquor ratio by a liquor containing:

15 grams per liter of N(2-hydroxy-3-chloropropyl)-N-benzyl-N,N-dimethylammonium formate, and 10 grams per liter of sodium hydroxide.

After washing, the yarn was dyed for 40 minutes at 90° C. by using Acid Green Color Index No. 12 to one percent deepness.

The dyeing process was followed by washing at 60° C.

The resulting color had excellent wet fastness values.

EXAMPLE 4

A cotton fabric dyed in the usual manner in a jigger by using Direct Blue C.I. No. 67 to 2 percent deepness was treated, after washing, in a jigger by a liquor containing:

5 grams per liter of N(2-chloro-3-hydroxypropyl)-N-benzyl-N,N-dimethylammonium chloride and
5 grams per liter of sodium hydroxide.

The fabric was treated in the liquor for 30 minutes at 40° C. whereupon it was washed up to neutral reaction. The color had excellent wash fastness at 95° C.

EXAMPLE 5

A viscose rayon fabric printed by reactive dyes
Reactive Red C.I. No. 45
Reactive Blue C.I. No. 13 and
Reactive Brown C.I. No. 2
was soaked, after the steam-fixation of the dyes, in a padder with a liquor containing:

25 grams per liter on N(2-chloro-3-hydroxypropyl)-N-benzyl-N,N-dimethylammonium chloride and
15 grams per liter of sodium hydroxide.

The fabric was left to mature in batch in the liquor for 12 hours at a temperature of from 20° to 25° C.

The process was followed by washing in an open-width washing machine by letting it pass through three tanks with water at 90° C., another two tanks with water at 50° C. and finally one tank with cold water.

The resulting print had excellent water and wash fastness at 60° and 95° C., respectively.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. A process for dyeing fibrous materials comprising at least 15% cellulosic fibers with anion colorants, comprising subjecting the fibrous material, in a time span extending from a time before the dyeing operation to a time simultaneous with the dyeing operation, to the action of a cationic agent contained in an alkaline aqueous bath, in which a cationizing agent of the general formula

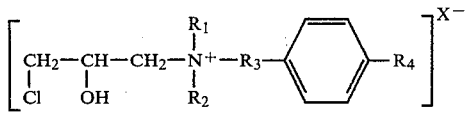

is used wherein $R_1$, $R_2$ are alkyls with 1–3 carbon atoms, $R_3$ is alkylene with 1–2 carbon atoms, $R_4$ is chosen from the group consisting of hydrogen atom and alkyl with 1–2 carbon atoms, and X is chosen from the group consisting of anion of a strong inorganic and an organic acid.

2. The process according to claim 1, wherein the fibrous material is subjected to said cationic agent before the dyeing operation.

3. The process according to claim 1, wherein the fibrous material is subjected to said cationic agent simultaneously with the dyeing operation.

* * * * *